US010487287B2

(12) United States Patent
Hartley et al.

(10) Patent No.: US 10,487,287 B2
(45) Date of Patent: Nov. 26, 2019

(54) OPTIMIZED COMPOSITION FOR ENGINE DEPOSITS AND SEALS

(71) Applicant: Chemizol Additives Private Limited, Bangalore (IN)

(72) Inventors: Rolfe Hartley, Rockway, NJ (US); Ricardo Bloch, Scotch Plains, NJ (US); Yantao Zhu, Liaoning (CN)

(73) Assignee: CHEMIZOL ADDITIVES PRIVATE LIMITED, Bangalore (IN)

( * ) Notice: Subject to any disclaimer, the term of this patent is extended or adjusted under 35 U.S.C. 154(b) by 134 days.

(21) Appl. No.: 15/396,013

(22) Filed: Dec. 30, 2016

(65) Prior Publication Data

US 2017/0190998 A1 Jul. 6, 2017

(30) Foreign Application Priority Data

Jan. 1, 2016 (IN) ..... 201641000027

(51) Int. Cl.

| | |
|---|---|
| ***C10L 1/22*** | (2006.01) |
| ***C10M 159/12*** | (2006.01) |
| ***C10M 163/00*** | (2006.01) |
| ***C10M 133/56*** | (2006.01) |

(52) U.S. Cl.

CPC ..... *C10M 159/12* (2013.01); *C10M 133/56* (2013.01); *C10M 163/00* (2013.01); *C10M 2215/064* (2013.01); *C10M 2215/28* (2013.01); *C10M 2219/046* (2013.01); *C10M 2223/045* (2013.01); *C10M 2227/066* (2013.01); *C10N 2210/02* (2013.01); *C10N 2220/021* (2013.01); *C10N 2230/04* (2013.01); *C10N 2230/06* (2013.01); *C10N 2230/08* (2013.01); *C10N 2230/10* (2013.01); *C10N 2230/18* (2013.01); *C10N 2230/36* (2013.01); *C10N 2240/10* (2013.01); *C10N 2240/102* (2013.01); *C10N 2240/104* (2013.01); *C10N 2270/00* (2013.01)

(58) Field of Classification Search

CPC ..... C10M 149/22; C10M 149/10
USPC ..... 508/232, 192
See application file for complete search history.

(56) References Cited

U.S. PATENT DOCUMENTS

| | | | | |
|---|---|---|---|---|
| 6,165,235 | A * | 12/2000 | Kolp | C08F 8/46 44/331 |
| 2009/0029888 | A1* | 1/2009 | Ravichandran | C07F 11/005 508/362 |
| 2012/0046206 | A1* | 2/2012 | Gieselman | C10M 133/12 508/283 |

* cited by examiner

*Primary Examiner* — Prem C Singh
*Assistant Examiner* — Francis C Campanell
(74) *Attorney, Agent, or Firm* — Womble Bond Dickinson (US) LLP

(57) ABSTRACT

The present disclosure is directed to an additive composition for engine oils comprising; (a) an alkenyl-substituted succinic anhydride and (b) a polyamine compound and (C) Co-additives, wherein the reaction product has a ratio of the amide to imide infrared absorption peak areas of about 1:1.2 to about 1.6. The said reaction product is effective to prevent engine deposits along with protecting elastomeric seal material of an internal combustion engine and also improves piston cleanliness and ring sticking performance of an internal combustion engine.

25 Claims, No Drawings

OPTIMIZED COMPOSITION FOR ENGINE DEPOSITS AND SEALS

FIELD OF THE INVENTION

To develop an optimized composition for engine deposits and seals containing imides and amides derived from succinic anhydrides and amines.

BACKGROUND OF THE INVENTION

Fresh engine oil is a clear, free-flowing liquid blend of base stock and additives that contains no fuel, water, coolant, dirt, or other contaminants.

When regular engine oil changes are neglected, normally free-flowing lubricating oil breaks down, becomes contaminated, ceases to flow, and is transformed into a thick soup of waste products. That's when serious engine damage is imminent.

Chemistry teaches that engine oil is unstable and decomposes in the presence of oxygen at high temperature. The process, called oxidation, occurs naturally after exposure to normal operating conditions for extended periods of time and is accelerated by exposure to severe operating conditions or to excessively high temperatures. Alternatively, accelerated oxidation may be triggered by a combination of any or all of these factors.

During oxidation, the chemical bonds that define the oil molecules are broken, and some of the reaction products accumulate and interact to form a highly viscous complex mixture of solids, liquids, and gases that contain a variety of solid carbon-based dirt and metallic particles, as well as liquid coolant, fuel, oil and water droplets.

A typical internal combustion engine is just an air compressor in which fuel is mixed with compressed air and then burned. The combustion process generates heat and a variety of reaction products, some of which enter the crankcase as blow-by and contaminate the oil, e.g., fuel, soot, water and other normal reactants, products and by-products.

Even though the oil temperature is high enough to boil off and extract all the water and other volatile contaminants via the PCV system, this crankcase broth will inevitably change into a deposit that does not drain when the oil is changed. Air-cooled gas or diesel engines are just air compressors in which the engine oil is subject to oxidation because they are exposed to higher temperatures and contamination by combustion products. If the engine is liquid-cooled, the engine oil may also become contaminated with coolant.

Sludge formation is not a new problem. In fact, sludge deposits limited the durability of early internal combustion engines. Over the years, oil base stocks were improved, detergent oil additives were developed to keep microscopic sludge-forming solid particles in suspension, anti-oxidation additives were developed to slow the formation of these sludge deposit precursors, and engine oil filters were fitted to remove suspended solid particles from the oil stream and slow the formation of flow restricting sludge deposits on internal surfaces. (Engine Sludge Origins—Don Fedak—Sep. 1, 2001)

Secondly, lubricating compositions also come into contact with seals within the engine in which they are used. Seals are made out of various materials, including nitrile-butadiene rubber (NBR) due to its relatively low cost and high availability, as well as fluorinated elastomers, silicones, and polycarbonates. It is essential that the lubricating composition used has good compatibility with the seals otherwise seals are degraded over time to the point that they fail, leading to fluid leakage increasing maintenance costs, longer down time, and even the risk of engine damage.

Seals deteriorate over time because of heat and age. The stain or film around a push rod tube cover, or weeping around a seam can be eliminated by using certain additives which contain specific components to condition/recondition any seal it touches, keeping it flexible as if new. The result is a much cleaner engine compartment.

Different flexible elastomer seals and gaskets are commonly used in all internal combustion engines of automotive, in particular to prevent contamination and lubricant leakage at those points where moving parts, such as the crankshaft, are in contact with the engine. The main types of these polymer materials are fluoroelastomer, polyacrylates, polysiloxanes and nitrile rubber. The prevention of the deterioration of said seals is very important from the viewpoint of both reliable operation and environmental aspects. There are two primary mechanisms by which seal damage can occur, abrasion due to solid contaminants and the attack of various engine oil compounds. Abrasive damage is not common since most engines have effective lubricant filtration system. The lubricant related damage can occur when some of various lubricant components diffuse into the seals. This will either cause a change in the hardness, thereby leading to swelling and/or elongation, or extract the plasticizer agent used to impart flexibility and strength to polymeric materials.

The unconventional base oils can seriously deteriorate the elastomer seals by extracting their plasticizer compounds causing embrittlement, shrinkage and leakage or penetrating into the elastomer causing swelling. To solve this problem optimal balance of base oils should be applied or so called seal swelling agents (such as dioctyl-sebacate, dihexyl-phthalate, tridecyl-alcohol and organic phosphates, polybutenyl succinic anhydride etc.) have to be used. The elastomer seals can be highly attacked under engine operating conditions by nitrogen containing dispersants, which are used in engine oils in great concentrations (6-10%). These additives contain strongly basic amino groups, which have otherwise high thermal stability and chemical resistance, base-catalyzed elimination occurs, with the consequent formation of unsaturations, and thus the deteriorated elastomer loses elasticity and elongation until it no longer possesses sealing capacity. These problems can easily be occurred due to the presence of low molecular weight succinimides, succinamides and free amines, which can be found in dispersants. Because of their high polarity and small size, these molecules are more likely to diffuse into the seal material and alter its properties. Removal of the free amine and low molecular weight succinimides improves seal performance.

In general, for a given polyisobutenylsuccinimide type dispersant, a higher nitrogen content gives better dispersancy and soot handling but poorer elastomer compatibility. On the other hand, as the operating temperature of the engine rises the rate of the decomposition of the seal rises proportionately.

The balance between soot handling and seal compatibility has provided lubricant formulators with significant challenges over the past ten years, especially as seal testing is a major part of the engine oil approval process around the world. There are numerous ASTM, DIN, ISO, CEC and local standards for investigation of the seal compatibility of engine oils and these can be found in the requirements of performance levels of engine oils.

Reference can be made to Canadian Patent 2523904 which discloses about a novel dispersant having antioxidant properties is obtainable by reacting a succinimide type and/or Mannich type dispersant with a phenolic-substituted ester or acid.

Reference can be made to U.S. Pat. No. 5,925,151 which discloses about a detergent additive composition comprising the combination of a monosuccinimide, derived from polyisobutylene and a polyethylene polyamine, and an aromatic hydrocarbon diluent that may be used in diesel fuel to remove or prevent deposits.

Reference can be made to European Patent 0703959 which discloses about a method of reducing the presence of sludge or varnish precursors in a lubricating oil which comprises contacting a lubricating oil containing sludge or varnish precursors with an oil insoluble, oil wettable cross-linked amine comprising one or more compounds having a dispersant functional group and of an antioxidant functional group.

Reference can be made to European Patent 0310365 which discloses about an invention which provides a lubricating oil dispersant composition, as well as an additive concentrate or lubricant composition incorporating such dispersant, in which the nitrogen-containing moieties of the dispersant compound are compatible with fluorohydrocarbon-containing elastomeric engine seals.

Reference can be made to US Patent Application 20150191673 which discloses about an additive package for a lubricant composition that improves fluoropolymer compatibility of the lubricant composition. The additive package comprises a halide seal compatibility additive and a second seal compatibility additive. The second seal compatibility additive is different from the halide seal compatibility additive. The weight of the second seal compatibility additive in the additive package is greater than or equal to the weight of the halide seal compatibility additive in the additive package.

Reference can be made to European Patent 1354933 which discloses about a lubricating oil composition displaying excellent low temperature valve train wear performance, improved fuel economy retention properties and compatibility with fluoroelastomer-based engine seals.

NEED OF THE INVENTION

To develop an unique formulation which provides balance between deposit handling and seal compatibility, as in general, for a given polyisobutenylsuccinimide type dispersant, a higher nitrogen content gives better dispersancy and deposit handling but poorer seal compatibility. To overcome the above shortcomings it was required to develop a unique formulation which provides an optimal performance of seals and deposits.

OBJECTIVE OF THE INVENTION

The principal object of the present invention is to provide new formulation packages that improve the seal compatibility simultaneously exhibit deposit control property of lubricant compositions.

Another objective of the present invention is to provide optimal ratio of PIBSA to Polyamine.

Another objective of the present invention is to provide balance between deposit handling and seal compatibility.

Another objective of the present invention is to provide ratio of the amide to imide infrared absorption peak areas of about 1:1.2 to about 1.6.

Another objective of the present invention is to improve the engine piston cleanliness performance of said lubricating oil.

Yet another object of the present invention is a method for improving the wear life and other tribological properties of engine lubricated with a liquid or solid lubricant, said method comprising adding to the lubricant, sufficient amount of this unique formulation.

SUMMARY OF THE INVENTION

The present invention comprises a new additive which is effective to prevent engine deposits along with protecting elastomeric seal material of an internal combustion engine and also improves piston cleanliness and ring sticking performance of an internal combustion engine, comprising; (a) an alkenyl-substituted succinic anhydride, (b) a polyamine compound and (C) Co-additives.

DETAILED DESCRIPTION OF THE PRESENT INVENTION

The present invention provides a new additive which is effective to prevent engine deposits along with protecting elastomeric seal material of an internal combustion engine and also improves piston cleanliness and ring sticking performance of an internal combustion engine, comprising; (A) an alkenyl-substituted succinic anhydride, (B) a polyamine compound and (C) Co-additives.

Component A (Succinimide Dispersants)

The succinimides, for example, include alkenyl succinimides comprising the reaction products obtained by reacting an alkenyl succinic anhydride, acid, acid-ester or lower alkyl ester with an amine containing at least one primary amine group. The alkenyl succinic anhydride may be prepared readily by heating a mixture of olefin and maleic anhydride to about 180-220° C. The olefin is, in an embodiment, a polymer or copolymer of a lower monoolefin such as ethylene, propylene, isobutene and the like. In another embodiment the source of alkenyl group is from polyisobutene having a molecular weight up to 5,000 or higher. In another embodiment the alkenyl is a polyisobutene group having a molecular weight of about 500-5,000 and most preferably about 1300-2,500.

Component B (Polyamines)

The preferred polyamines used in the practice of this invention are the alkylene polyamines represented by the formula $H_2N(CH_2)n(NH(CH_2)n)mNH_2$, wherein n is 2 to 10 (preferably 2 to 4, more preferably 2 to 3, and most preferably 2) and m is 0 to 10, (preferably 1 to 6). Illustrative are ethylene diamine, diethylene triamine, triethylenetetramine, tetraethylenepentamine, spermine, pentaethylene hexamine, propylene diamine (1,3-propanediamine), butylene diamine (1,4-butanediamine), hexamethylene diamine (1,6-hexanediamine), decamethylene diamine (1,10-decanediamine), and the like. In some embodiments, the polyamine is a fatty diamine. In some embodiments, the fatty diamine is at least one selected from the group consisting of N-octyldiaminoalkanes, N-decyldiaminoalkanes, N-dodecyl diaminoalkanes, N-tetradecyldiaminoalkanes, N-hexadecyldiaminoalkanes, N-octadecyldiaminoalkanes, N-stearyldiaminoalkanes, N-oleyldiaminoalkanes, N-tallow diaminoalkanes, N-cocoyldiaminoalkanes, and N-soya diaminoalkanes.

Component C (Co-Additive)

The composition may include one or more co-additives to provide certain performance characteristics. Examples of such co-additives are dispersants, detergents, metal rust inhibitors, viscosity index improvers, corrosion inhibitors, oxidation inhibitors, friction modifiers, anti-foaming agents, anti-wear agents, base oils and pour point depressants. Some are discussed in further detail below.

Base Oils

The term "Group I base oil" as used herein refers to a petroleum derived lubricating base oil having a saturates content of less than 90 wt. % (as determined by ASTM D 2007) and/or a total sulfur content of greater than 300 ppm (as determined by ASTM D 2622, ASTM D 4294, ASTM D 4297 or ASTM D 3120) and has a viscosity index (VI) of greater than or equal to 80 and less than 120 (as determined by ASTM D 2270).

In general, a Group II base oil and Group III base oil can be any petroleum derived base oil of lubricating viscosity as defined in API Publication 1509, 14th Edition, Addendum 1, December 1998. API guidelines define a base stock as a lubricant component that may be manufactured using a variety of different processes. Group II base oils generally refer to a petroleum derived lubricating base oil having a total sulfur content equal to or less than 300 parts per million (ppm) (as determined by ASTM D 2622, ASTM D 4294, ASTM D 4927 or ASTM D 3120), a saturates content equal to or greater than 90 weight percent (as determined by ASTM D 2007), and a viscosity index (VI) of between 80 and 120 (as determined by ASTM D 2270).

Group III base oils generally have less than 300 ppm sulfur, saturates content greater than 90 weight percent, and a VI of 120 or greater. In one embodiment, the Group III base stock contains at least about 95% by weight saturated hydrocarbons. In another embodiment, the Group III base stock contains at least about 99% by weight saturated hydrocarbons.

Metal Sulphonate Detergent

Overbased detergents are known in the art. Overbased materials otherwise referred to as overbased or superbased salts are generally single phase, homogeneous systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, typically carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol.

Overbased sulphonates typically have a TBN of 250 to 600 mg KOH/gm, or 300 to 500. The metal sulphonate detergent may be an alkaline earth metal or alkali metal sulphonate. For example the metal may be sodium, calcium, barium, or magnesium. Typically other detergent may be sodium, calcium, or magnesium containing detergent (typically, calcium, or magnesium containing detergent). In one embodiment the metal may be calcium.

Friction Modifier

Friction modifiers and fuel economy agents that are compatible with the other ingredients of the final oil may also be included. Examples of such materials include oil-soluble organo-molybdenum compounds, such oil soluble organo-molybdenum compounds include dithiocarbamates, dithiophosphates, dithiophosphinates, xanthates, thioxanthates, sulfides, and the like, and mixtures thereof.

Particularly preferred are molybdenum dithiocarbamates. Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, MoOCl4, MoO2Br2, Mo2O3Cl6, molybdenum trioxide or similar acidic molybdenum compounds.

Antiwear

ZDDP is conventionally added to lubricating oil compositions in amounts of 0.1 to 10, preferably 0.2 to 2 wt. %, based upon the total weight of the lubricating oil composition. They may be prepared in accordance with known techniques. The preferred zinc dihydrocarbyl dithiophosphates are oil soluble salts of dihydrocarbyl dithiophosphoric acids and may be represented by the following formula:

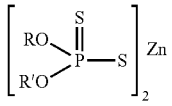

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, thexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates.

Antioxidants

Antioxidants or oxidation inhibitors are used to minimize the effect of oil deterioration that occurs when hot oil is contacted with air. The degree and rate of oxidation will depend on temperature, air and oil flow rates and, of particular importance, on the presence of metals that may catalytically promote oxidation. Antioxidants generally function by prevention of peroxide chain reaction and/or metal catalyst deactivation. They prevent the formation of acid sludges, darkening of the oil and increases in viscosity due to the formation of polymeric materials.

Non-limiting examples of suitable oxidation resistance (antioxidant) and thermal stability improvers are diphenly-, dinaphtyl-, and phenyl-naphthyl-amines, in which the phenyl and naphthyl groups can be substituted, for example, N,N'-diphenyl phenylenediamine, p-octyldiphenylamine, p-dioctyldiphenylamine, alkylated diphenylamine, alkylated phenyl alpha naphthylamine, N-phenyl-1-naphthyl amine, N-phenyl-2-naphthyl amine, N-(p-dodecyl)-phenyl-2-naphthyl amine, di-1-naphthylamine, and di-2-naphthylamine; phenothazines such as N-alkylphenothiazines; imino(-bis-benzyl); hindered phenols such as 6-(t-butyl)phenol, 2,6-di-(t-butyl)phenol, 4-methyl-2,6-di-(t-butyl)phenol, 4,4'-methylenebis(2,6-di-{t-butyl}-phenol), esters of 3,5-di-tert-butyl-4-hydroxyhydrocinnamic acid, thiodiethylene bis-(3, 5-di-tert-butyl-4-hydroxy) hydrocinnamate, esters of [[[3,5-bis(1,1-dimethylethyl)-4-hydroxyphenyl]methyl]thio]acetic acid and the like.

TABLE 1

| Finished Oil Formulation | | | |
|---|---|---|---|
| COMPONENTS, Wt % | Preferred Range | More Preferred Range | Most Preferred Range |
| 2300M. Wt. Borated Dispersant | 3-6 | 2-4 | 1.5-2.5 |
| 2300M. Wt. Monosuccinimide | 3-6 | 2-4 | 1.5-2.5 |
| C2/6 1° ZDDP | 1.5-3 | 1-1.5 | 0.25-1 |
| C6/4 2° ZDDP | 2.5-5 | 1.5-2.5 | 0.5-1.5 |
| Organo metallic Friction modifier | 1-2.5 | .5-1 | 0.25-.5 |
| Diphenylamine Antioxidant | 2.5-5 | 1.5-2.5 | 0.5-1.5 |
| Phenolic ester Antioxidant | 2.5-5 | 1.5-2.5 | 0.45-1.5 |
| Si Defoamer | .5-1 | .25-.5 | .05-.1 |
| Base Oil | 1.5-3 | 1-1.5 | 0.20-1 |
| 300BN Ca Sulfonate | 3-6 | 2-4 | 1.20-2 |

In forming the formulation of this invention, the finished oil will usually contain above described components.

EXAMPLES

Example—1

The reaction of the polyisobutylene and the polyamine was carried out in a solvent in which the reactants and the intermediates were readily dissolved; the reaction was maintained at a temperature of 130-160° C. to result an amide.

The product formed was then aged at a temperature ranging from 60-80° C. for a period ranging from 0.5-4 weeks.

The reaction product is characterized by an FTIR spectrum having peak intensity in a region of from about 1549 cm-1 to about 1703 cm-1, wherein said reaction product has a ratio of the amide to imide infrared absorption peak areas of about 1:1.2 to about 1.6.

Example—2

MHT-4 TEOST Bench Test

The TEOST MHT approach was designed to simulate the deposit-forming tendencies of engine oil in the piston-ring belt and upper piston crown area. The MHT-4 TEOST (ASTM D7097) is a bench test used to evaluate oil performance relative to forming Moderately High Temperature Piston Deposits when subjected to high power and temperature operating conditions. The performance parameter is the weight of deposits on a heated metal rod.

Results

| Sl. no | Test Sample | Upper Limit (SN/GF-5) | Result (Instant Formulation) |
|---|---|---|---|
| 1 | Instant Composition | 35 | 16 |

Example—3

KHT Bench Test

The Hot Tube Test evaluates the high temperature stability of a lubricant. Oil droplets are pushed up by air inside a heated narrow glass capillary tube and the thin film oxidative stability of the lubricant is measured by the degree of lacquer formation on the glass tube, the resulting colour of the tube being rated on a scale of 0-10. A rating of 0 refers to heavy deposit formation and a rating of 10 means a clean glass tube at the end of the test. The method is described in SAE paper 840262. The level of lacquer formation in the tube reflects the high temperature stability of the oil and its tendency during service to form deposits in high temperature areas of the engine.

Results

| Sl. no | Test Sample | Rating @280° | Result (Instant Formulation) |
|---|---|---|---|
| 1 | Instant Composition | 0-10 | 6 |

Example—4

Sequence IV A (ASTM D 6891)

This test method measures the ability of crankcase oil to control camshaft lobe wear for spark-ignition engines equipped with an overhead valve-train and sliding cam followers. This test method is designed to simulate extended engine idling vehicle operation. The primary result is camshaft lobe wear. Secondary results include cam lobe nose wear and measurement of iron wear metal concentration in the used engine oil. This test method was developed to evaluate automotive lubricant's effect on controlling cam lobe wear for overhead valve-train equipped engines with sliding cam followers.

| S. No | PARAMETERS | REQUIREMENT | RESULTS (Instant Formulation) | STATUS |
|---|---|---|---|---|
| 1 | Cam Wear Avg, μm | Max. 120 | 15.73 | PASS |

Example—5

Sequence III H

This test method evaluates automotive engine oils for certain high-temperature performance characteristics, including oil thickening, varnish deposition, oil consumption, as well as engine wear. Such oils include both single viscosity grade and multi viscosity grade oils that are used in both spark-ignition, gasoline-fueled engines, as well as in diesel engines. This test method was developed to evaluate automotive engine oils for protection against oil thickening and engine wear during moderately high-speed, high-temperature service.

| SEQUENCE IIIH | | | | |
|---|---|---|---|---|
| S. No. | PARAMETERS | PROPOSED LIMIT | RESULTS (Instant Formulation) | STATUS |
| 1 | K.V. Increase @40 deg C., % | 150 max. | 34.50 | PASS |
| 2 | Avg. Weighted Piston Deposit, merit | 3.7 min. | 5.09 | PASS |

-continued

| SEQUENCE IIIH-A | | | | |
|---|---|---|---|---|
| S. No. | PARAMETERS | REQUIREMENT | RESULTS (Instant Composition) | STATUS |
| 1 | MRV, cP | 60,000 max. | 19,720 | PASS |
| 2 | Yield Stress, Pa | Y <= 35 | Y <= 35 | PASS |

| SEQUENCE IIIH-B | | | | |
|---|---|---|---|---|
| S. No. | PARAMETERS | PROPOSED LIMIT | RESULTS (Instant Composition) | STATUS |
| 1 | Phosphorous Retention, % | 80.5 min. | 80.49 | PASS |

Example—6

Sequence VG Test Engine (ASTM D 6593)

This test method correlated with vehicles used in stop-and-go service prior to 1996, particularly with regards to sludge and varnish formation. This test method is used to evaluate an automotive engine oil's control of engine deposits under operating conditions deliberately selected to accelerate deposit formation. It is one of the test methods required to evaluate oils intended to satisfy the API SL performance category. The test stand is equipped to control speed, torque, AFR, and various other operating parameters. The test is run for a total of 216 h, consisting of 54 cycles of 4 h each. Each cycle consists of three stages. While the operating conditions are varied within each cycle, overall, they can be characterized as a mixture of low-temperature and moderate-temperature, light and medium duty operating conditions.

| S. No | PARAMETERS | REQUIREMENT | RESULTS (Instant Formulation) | STATUS |
|---|---|---|---|---|
| 1 | Avg. Engine sludge, merit | Min. 8 | 9.33 | PASS |
| 2 | Rocker arm cover sludge, merit | Min. 8.3 | 9.48 | PASS |
| 3 | Avg. Piston Skirt Varnish, merit | Min. 7.5 | 8.97 | PASS |
| 4 | Avg. Engine Varnish, merit | Min. 8.9 | 9.59 | PASS |
| 5 | Oil Screen clogging, % | Max. 15 | 2.00 | PASS |
| 6 | Number of hot stuck rings | 0 | 0 | PASS |

Example—7

Sequence VIII Test Engine (ASTM D 6709)

This test method covers the evaluation of automotive engine oils both single viscosity grade and multi viscosity grades intended for use in spark-ignition gasoline engines. The test procedure is conducted using a carburetted, spark-ignition Cooperative Lubrication Research (CLR) Oil Test Engine (also referred to as the Sequence VIII test engine in this test method) run on unleaded fuel. An oil is evaluated for its ability to protect the engine and the oil from deterioration under high-temperature and severe service conditions. The test method can also be used to evaluate the viscosity stability of multi viscosity-graded oils. This test method is used to evaluate automotive engine oils for protection of engines against bearing weight loss and used to evaluate the SIG capabilities of multi viscosity-graded oils.

| S. No | Parameters | Requirement | Results (Instant Formulation) | Status |
|---|---|---|---|---|
| 1 | Bearing weight loss, mg | Max. 26 | 4.2 | PASS |
| 2 | Stripped viscosity cSt at 100 deg C. | Stay in grade - 9.3 - 12.5 cSt | 10.44 | PASS |

Example—8

GF 5 Test (ASTM D 7216)

Standard Test Method for Determining Automotive Engine Oil Compatibility with Typical Seal Elastomers Some engine oil formulations have been shown to lack compatibility with certain elastomers used for seals in automotive engines. These deleterious effects on the elastomer are greatest with new engine oils (that is, oils that have not been exposed to an engine's operating environment) and when the exposure is at elevated temperatures. This test method covers quantitative procedures for the evaluation of the compatibility of automotive engine oils with several reference elastomers typical of those used in the sealing materials in contact with these oils. Compatibility is evaluated by determining the changes in volume, Durometer A hardness and tensile properties when the elastomer specimens are immersed in the oil for a specified time and temperature. Effective sealing action requires that the physical properties of elastomers used for any seal have a high level of resistance to the liquid or oil in which they are immersed. When such a high level of resistance exists, the elastomer is said to be compatible with the liquid or oil. This test method provides a preliminary or first order evaluation of oil/elastomer compatibility only.

| Sl. No. | Parameters | Requirements | Results Instant Formulation | Status |
|---|---|---|---|---|
| | | SAE J2643 ACM-1 | | |
| 1 | Tensile Strength [Mpa], % | −40 to 40 | 6.4 | Pass |
| 2 | Elongation Rupture, % | To report | 7.7 | |
| 3 | Hardness Shore A, Points | −10 to 10 | 6.0 | Pass |
| 4 | Volume Variation, % | −5 to 9 | 1.27 | Pass |
| | | SAE J2643 HNBR-1 | | |
| 1 | Tensile Strength [Mpa], % | −20 to 15 | 2.5 | Pass |
| 2 | Elongation Rupture, % | To report | −17.5 | |
| 3 | Hardness Shore A, Points | −10 to 5 | 0.0 | Pass |
| 4 | Volume Variation, % | −5 to 10 | −0.08 | Pass |
| | | SAE J2643 VMQ-1 | | |
| 1 | Tensile Strength [Mpa], % | −50 to 5 | −28.7 | Pass |
| 2 | Elongation Rupture, % | To report | −17.7 | |
| 3 | Hardness Shore A, Points | −30 to 10 | −17.0 | Pass |
| 4 | Volume Variation, % | −5 to 40 | 23.12 | Pass |
| | | SAE J2643 FKM-1 | | |
| 1 | Tensile Strength [Mpa], % | −65 to 10 | −22.1 | Pass |
| 2 | Elongation Rupture, % | To report | −26.4 | |
| 3 | Hardness Shore A, Points | −6 to 6 | 0.0 | Pass |
| 4 | Volume Variation, % | −2 to 3 | 0.93 | Pass |

-continued

| Sl. No. | Parameters | Requirements | Results Instant Formulation | Status |
|---|---|---|---|---|
| | | SAE J2643 AEM-1 | | |
| 1 | Tensile Strength [Mpa], % | −30 to 30 | −6.5 | Pass |
| 2 | Elongation Rupture, % | To report | −28.8 | |
| 3 | Hardness Shore A, Points | −20 to 10 | −8.0 | Pass |
| 4 | Volume Variation, % | −5 to 30 | 17.01 | Pass |

We claim:

1. A composition, which is characterized in that said composition comprising a compound derived from a reaction of (A) an alkenyl-substituted succinic anhydride and (B) a polyamine compound, and said composition further comprises (C) co-additives;

wherein said compound has a ratio of the amide to imide infrared absorption peak areas of about 1:1.2 to about 1.6:1.

2. The composition as claimed in claim 1, wherein the molar ratio of the alkenyl-substituted succinic anhydride to the primary amino Nitrogen of the polyamine is less than 1.

3. The composition as claimed in claim 1, wherein the alkenyl-substituted succinic anhydride is a polyisobutylene succinic anhydride, which is present in a dispersant of polyisobutylene succinic imide or a dispersant blend comprising polyisobutylene succinic imide.

4. The composition as claimed in claim 3, wherein the said dispersant is a dispersant blend comprising polyisobutylene succinic imide.

5. The composition as claimed in claim 4, wherein said dispersant blend comprising polyisobutylene succinic imide further comprises a bisimide, with or without boration.

6. The composition as claimed in claim 5, wherein said bisimide is having a ratio of succinic to primary amine between 0.9 and 1.2.

7. The composition as claimed in claim 5, wherein the molar amount of boron in the bisimide dispersant is in the range of 0.01-250% moles of Nitrogen in the bisimide dispersant.

8. The composition as claimed in claim 3, wherein the alkenyl of the alkenyl-substituted succinic anhydride is a polyisobutylene group having a number average molecular weight of about 1400 to about 2500.

9. The composition as claimed in claim 1, wherein the moles of anhydride in the alkenyl-substituted succinic anhydride and the primary amino Nitrogen in the polyamine are present in the reaction in a molar ratio of about 0.4 to about 0.9.

10. The composition as claimed in claim 1, wherein the polyamine is selected from the group comprising of ethylenediamine, diethylenetriamine, triethylenetetramine, trimethyl amine, n-propylamine, isopropyl amine, tetraethylenepentamine, pentaethylenehexamine, polyethylene polyamine, and mixtures of two or more thereof.

11. The composition as claimed in claim 1, wherein the polyamine is a polyethylenepolyamine.

12. A process for making the compositions as claimed in claim 1, comprising (1) reacting an alkenyl-substituted succinic anhydride with an amine at 130-160° C. forming an imide and (2) the product formed is aged at a temperature ranging from 60–80° C. for a period ranging from 0.5-4 weeks.

13. An additive package, comprising the composition as claimed in claim 1 in an amount ranging from 1-12 wt %.

14. The composition as claimed in claim 1, wherein the co-additives include from the group comprising of detergents, dispersants, ZDDP, antioxidants, friction reducers and antifoament.

15. The composition as claimed in claim 14, wherein the said detergent is an overbased metal compound present in a range of 1.45-2% w/w.

16. The composition as claimed in claim 15, wherein the overbased metal compound is an overbased calcium sulphonate.

17. The composition as claimed in claim 14, wherein the said ZDDP is present in a range of 0.25-1.5% w/w.

18. The composition as claimed in claim 17, wherein the alkyl group present in ZDDP has same or different hydrocarbyl radicals containing from 2-8 carbon atoms.

19. The composition as claimed in claim 14, wherein said Friction modifier is present in a range of 0.25-0.5% w/w.

20. The composition as claimed in claim 19, wherein said friction modifier is molybdenum based friction modifier.

21. The composition as claimed in claim 14, wherein said antioxidant is present in a range of 0.5-1.5 w/w.

22. The composition as claimed in claim 21, wherein said antioxidant is selected from the group consisting of diphenyl amines and alkyl derivatives having from about 4 to 20 carbon atoms in the alkyl group.

23. A method for preventing the deposits, comprising the addition of the composition as claimed in claim 1 to the engine oil.

24. A method for protecting elastomeric seal material in the engine, comprising the addition of the composition as claimed in claim 1 to the engine oil.

25. A method for improving piston cleanliness and ring sticking performance of engine oil, comprising the addition of the composition as claimed in claim 1 to the engine oil.

* * * * *